US007937774B1

(12) United States Patent
King

(10) Patent No.: US 7,937,774 B1
(45) Date of Patent: May 10, 2011

(54) FINGER PROTECTOR FOR USING A HAMMER

(76) Inventor: Martin A. King, Los Angeles, CA (US)

( * ) Notice: Subject to any disclaimer, the term of this patent is extended or adjusted under 35 U.S.C. 154(b) by 626 days.

(21) Appl. No.: 12/034,354

(22) Filed: Feb. 20, 2008

(51) Int. Cl.
*A41D 19/00* (2006.01)

(52) U.S. Cl. ..... 2/161.1; 2/163

(58) Field of Classification Search ..... 2/16, 20, 2/161.1, 161.6, 163
See application file for complete search history.

(56) References Cited

U.S. PATENT DOCUMENTS 1,951,190 A * 3/1934 Gambee ..... 2/21
2,448,697 A * 9/1948 Bakke ..... 2/16
4,272,849 A * 6/1981 Thurston et al. ..... 2/16
4,766,612 A * 8/1988 Patton, Sr. ..... 2/16
4,796,302 A 1/1989 Davis
D335,938 S 5/1993 Kam
5,819,312 A 10/1998 Snyder
5,911,309 A * 6/1999 Penney ..... 2/16
6,925,653 B1 8/2005 King
2004/0107476 A1* 6/2004 Goldwitz ..... 2/159
2005/0086722 A1* 4/2005 Bjorntwedt ..... 2/161.6

* cited by examiner

*Primary Examiner* — Katherine Moran

(57) ABSTRACT

A finger protector for using a hammer includes a glove with a back hand covering, a palm covering, a thumb sleeve and four finger sleeves. The finger sleeves include a first finger sleeve positioned adjacent to the thumb sleeve. A thumb covering is attached to the thumb sleeve and has a size and shape to be removably positioned on an upper surface of the thumb so that the thumb covering extends along a length of and downwardly on either side of the thumb.

16 Claims, 4 Drawing Sheets

FINGER PROTECTOR FOR USING A HAMMER

BACKGROUND OF THE INVENTION

Field of the Invention

The present invention relates to finger protecting devices and more particularly pertains to a new finger protecting device for preventing injuries to a hand struck by a hammer.

SUMMARY OF THE INVENTION

The present invention meets the needs presented above by generally comprising a glove that includes a back hand covering, a palm covering, a thumb sleeve and four finger sleeves. The finger sleeves include a first finger sleeve positioned adjacent to the thumb sleeve. A thumb covering is attached to the thumb sleeve and has a size and shape to be removably positioned on an upper surface of the thumb so that the thumb covering extends along a length of and downwardly on either side of the thumb.

The present invention meets the needs presented above by also generally comprising a glove including a back hand covering, a palm covering, a thumb sleeve and four finger sleeves. The finger sleeves include a first finger sleeve positioned adjacent to the thumb sleeve. A finger covering is attached to the first finger sleeve and has a size and shape to cover an upper surface of a finger and extend along the length of the finger. The finger covering extends downwardly on a lateral edge of the finger when the finger is positioned in the first finger sleeve. The finger covering has a first end and a second end and a break therein generally positioned between the first and second ends so that a first portion and a second portion are defined. The first portion is pivotally coupled to the second portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
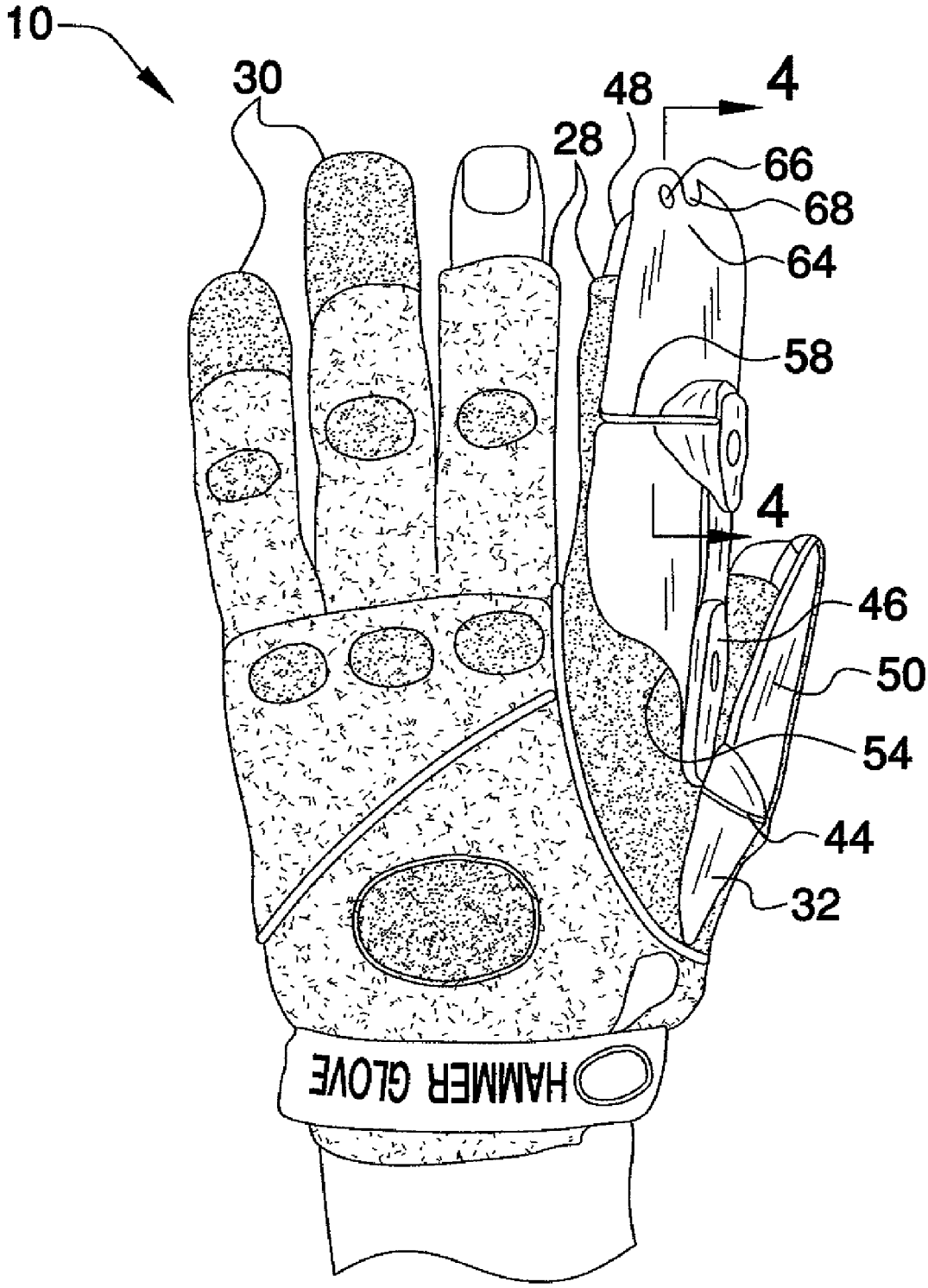
FIG. 1 is a front view of a finger protector for using a hammer according to the present invention.
Figure 2:
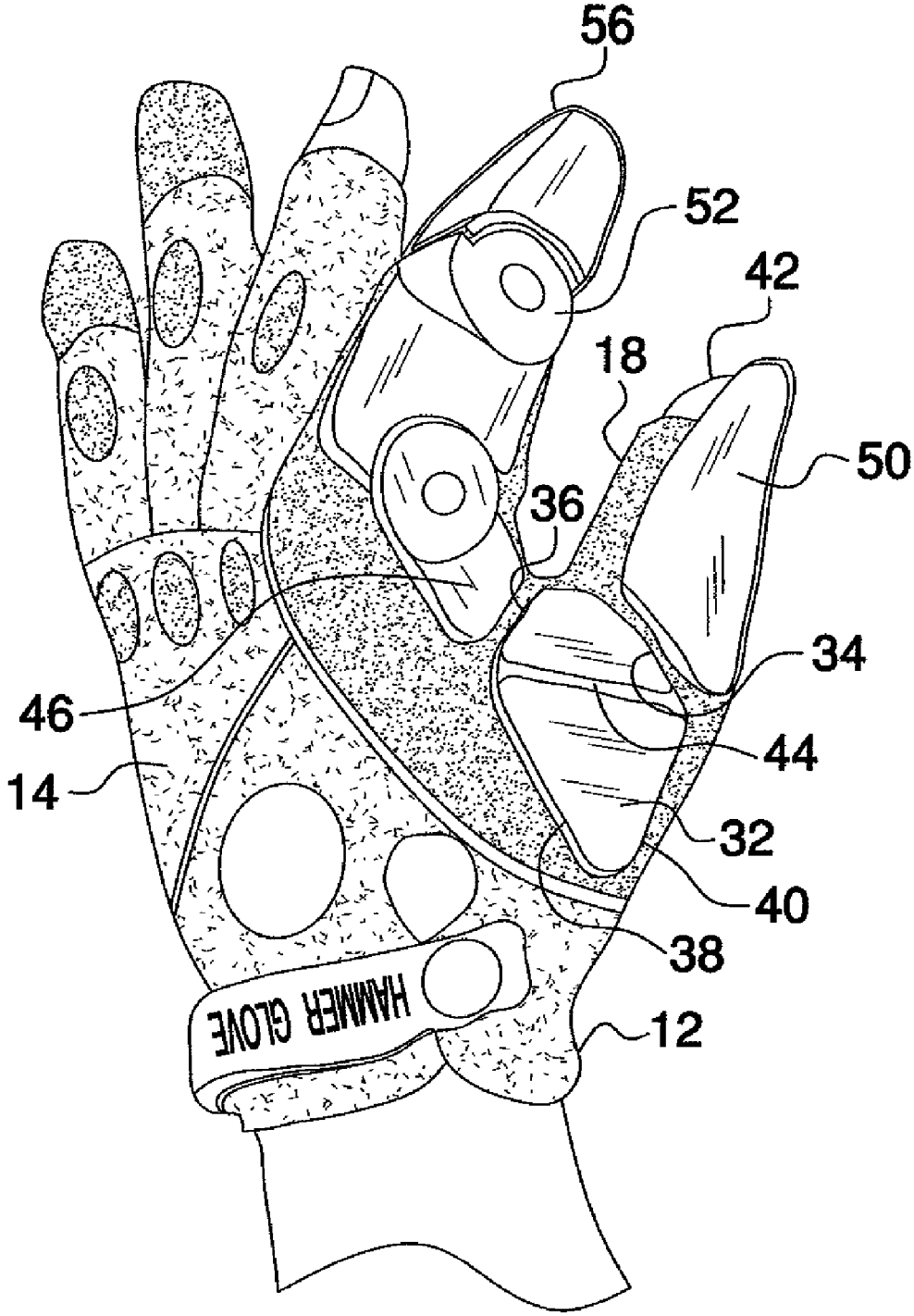
FIG. 2 is a side perspective view of the present invention.
Figure 3:
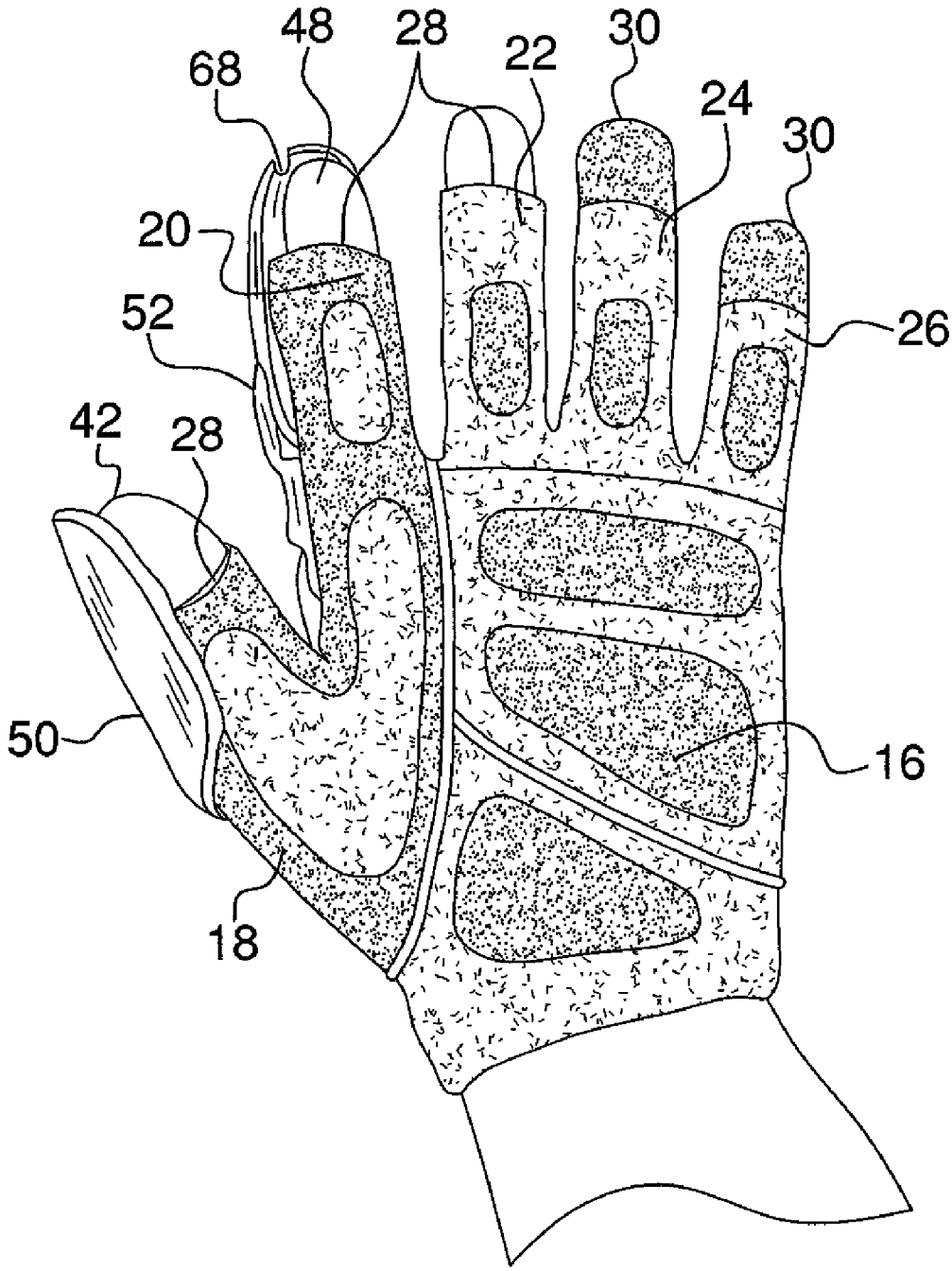
FIG. 3 is a rear view of the present invention.
Figure 4:
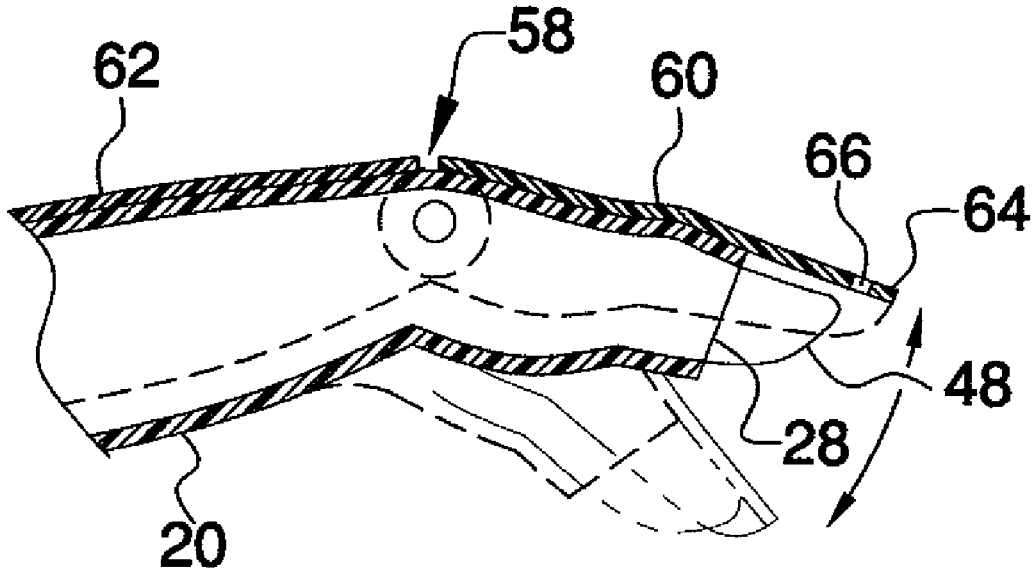
FIG. 4 is a cross-sectional view taken along line 4-4 of FIG. 1 of the present invention.

With reference now to the drawings, and in particular to FIGS. 1 through 4 thereof, a new finger protecting device embodying the principles and concepts of the present invention and generally designated by the reference numeral 10 will be described.

As best illustrated in FIGS. 1 through 4, the finger protector for using a hammer 10 generally comprises a glove 12 that includes a back hand covering 14, a palm covering 16, a thumb sleeve 18 and four finger sleeves. The finger sleeves include a first finger sleeve 20, a second finger sleeve 22, a third finger sleeve 24 and a fourth finger sleeve 26. The first finger sleeve 20 is positioned adjacent to the thumb sleeve 18 and the second finger sleeve 22 is positioned adjacent to the first finger sleeve 20. The first 20 and second 22 finger sleeves and the thumb sleeve 18 each have an open end 28 to allow for the easy gripping of a nail. The third 24 and fourth 26 finger sleeves have closed ends 30.

A first plate 32 has a first edge 34, a second edge 36, a third edge 38 and a fourth edge 40. The first plate 32 is attached to the back hand covering 14 adjacent to a juncture of the thumb sleeve 18 and has a shape for removably covering a knuckle of a thumb 42. The first edge 34 is positioned adjacent to the thumb sleeve 18. The second edge 36 abuts the first 34 and third 38 edges and is positioned adjacent to the first finger sleeve 22. The first plate 32 has a bend 44 therein extending between a juncture of the first 34 and fourth 40 edges and a juncture of the second 36 and third 38 edges. The bend 44 forms an angle in an outer surface of the first plate 32 generally between 200 degrees and 270 degrees to help deflect a blow from a hammer and to contour to the shape of the first plate 32 of a user's hand.

A second plate 46 is attached to the back hand covering 14 and is positioned at a juncture of the first finger sleeve 20 and the back hand covering 14. The second plate 46 is positioned adjacent to the first plate 32. The second plate 46 is positioned on a lateral edge of a knuckle of the finger 48, and in particular the index finger, when the finger 48 is positioned in the first sleeve 28.

A thumb covering 50 is attached to the thumb sleeve 18 and has a size and shape to be removably positioned on an upper surface of the thumb 42 so that the thumb covering 50 extends along a length of and downwardly on either side of the thumb 42. A finger covering 52 is attached to the first finger sleeve 20 and has a size and shape to cover an upper surface of the finger 48 and extend along the length of the finger 48. The finger covering 52 extends downwardly on a lateral edge of the finger 48 adjacent to the thumb 42 when the finger 48 is positioned in the first finger sleeve 20. The finger covering 52 has a first end 54 and a second end 56. The first end 54 is rotationally coupled to the second plate 46. The finger covering 52 has a break 58 therein generally positioned between the first 54 and second 56 ends so that a first portion 60 and a second portion 62 are defined. The first portion 60 is pivotally coupled to the second portion 62. An extension 64 is attached to the second end 56 of the finger covering 52. The extension 64 extends past an end of the finger 48. The finger covering 52, thumb covering 52, first plate 32 and second plate 46 are each comprised of a rigid material such as injected molded plastic or a metallic material. The finger covering 52 has an aperture 66 extending therethrough that is positioned adjacent to the extension 64. The extension 66 has a free edge that has a notch 68 extending therein. The aperture 66 and the notch 68 are used for holding particularly small nails until they have been driven into a support medium.

In use, the glove 12 is worn in a conventional manner and supports the plates 32, 46 and coverings 50, 52 on the user's hand while providing free movement of the fingers and thumb. If the finger 48, thumb 42 or adjacent areas are struck by a hammer while the user is striking nails, the plates 32, 46 and coverings 50, 52 will prevent damages to the finger and thumb.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hand protecting device for removably positioning on a hand while using a hammer, said device comprising:

a glove including a back hand covering, a palm covering, a thumb sleeve and four finger sleeves, said finger sleeves including a first finger sleeve positioned adjacent to said thumb sleeve; and a thumb covering being attached to said thumb sleeve and having a size and shape to be removably positioned on an upper surface of the thumb so that said thumb covering extends along a length of and downwardly on either side of the thumb;

a first plate being attached to said back hand covering adjacent to a juncture of said thumb sleeve and having a shape for removably covering a knuckle of the thumb when the thumb is positioned in said thumb sleeve, said first plate having a first edge, a second edge, a third edge, and a fourth edge, said first edge being positioned adjacent to said thumb sleeve, said second edge abutting said first and third edges and being positioned adjacent to said first finger sleeve, said first plate having a bend therein extending between a juncture of said first and fourth edges and a juncture of said second and third edges.

2. The device according to claim 1, wherein said finger sleeves further include a second finger sleeve, a third finger sleeve and a fourth finger sleeve, said second finger sleeve being positioned adjacent to said first finger sleeve, said first and second finger sleeves and said thumb sleeve having open ends, said third and fourth finger sleeves having closed ends.

3. The device according to claim 1, wherein said bend forms an angle in an outer surface of said first plate between 200 degrees and 270 degrees.

4. The device according to claim 1, further including a finger covering being attached to said first finger sleeve and having a size and shape to cover an upper surface of the finger and extend along the length of the finger, said finger covering extending downwardly on a lateral edge of the finger when the finger is positioned in the first finger sleeve.

5. The device according to claim 4, wherein said finger covering has a first end and a second end, said finger covering having a break therein generally positioned between said first and second ends so that a first portion and a second portion are defined, said first portion being pivotally coupled to said second portion.

6. The device according to claim 5, further including an extension being attached to said second end of said finger covering, said extension being extending past an end of the finger.

7. The device according to claim 6, wherein said finger covering has an aperture extending therethrough, said aperture being positioned adjacent to said extension.

8. The device according to claim 6, wherein said extension has a free edge having notch extending therein.

9. The device according to claim 4, further including a second plate being attached to said back hand covering and being positioned at a juncture of said first finger sleeve and said back hand covering, said second plate being positioned on a lateral edge of a knuckle of the finger when the finger is positioned in the first sleeve, said first end of said finger covering being rotationally coupled to said second plate.

10. A hand protecting device for removably positioning on a hand while using a hammer, said device comprising:

a glove including a back hand covering, a palm covering, a thumb sleeve and four finger sleeves, said finger sleeves including a first finger sleeve positioned adjacent to said thumb sleeve; and a finger covering being attached to said first finger sleeve and having a size and shape to cover an upper surface of the finger and extend along the length of the finger, said finger covering extending downwardly on a lateral edge of the finger when the finger is positioned in the first finger sleeve, said finger covering having a first end and a second end, said finger covering having a break therein generally positioned between said first and second ends so that a first portion and a second portion are defined, said first portion being pivotally coupled to said second portion;

an extension being attached to said second end of said finger covering, said extension extending past an end of the finger, said extension having a free edge having notch extending therein.

11. The device according to claim 10, wherein said finger covering has an aperture extending therethrough, said aperture being positioned adjacent to said extension.

12. The device according to claim 10, further including a first plate being attached to said back hand covering adjacent to a juncture of said thumb sleeve and having a shape for removably covering a knuckle of the thumb when the thumb is positioned in said thumb sleeve.

13. The device according to claim 12, further including a second plate being attached to said back hand covering and being positioned at a juncture of said first finger sleeve and said back hand covering, said second plate being positioned on a lateral edge of a knuckle of the finger when the finger is positioned in the first sleeve, said first end of said finger covering being rotationally coupled to said second plate.

14. The device according to claim 13, further including a thumb covering being attached to said thumb sleeve and having a size and shape to be removably positioned on an upper surface of the thumb so that said thumb covering extends along a length of and downwardly on either side of the thumb.

15. The device according to claim 14, wherein said first plate has a first edge, a second edge, a third edge, and a fourth edge, said first edge being positioned adjacent to said thumb sleeve, said second edge abutting said first and third edges and being positioned adjacent to said first finger sleeve, said first plate having a bend therein extending between a juncture of said first and fourth edges and a juncture of said second and third edges, said bend forming an angle in an outer surface of said first plate generally between 200 degrees and 270 degrees.

16. A thumb and finger protecting device for removably positioning on a hand while using a hammer, said device comprising:

a glove including a back hand covering, a palm covering, a thumb sleeve and four finger sleeves, said finger sleeves including a first finger sleeve, a second finger sleeve, a third finger sleeve and a fourth finger sleeve, said first finger sleeve being positioned adjacent to said thumb sleeve, said second finger sleeve being positioned adjacent to said first finger sleeve, said first and second finger sleeves and said thumb sleeve having open ends, said third and fourth finger sleeves having closed ends;

a first plate having a first edge, a second edge, a third edge, and a fourth edge, said first plate being attached to said back hand covering adjacent to a juncture of said thumb sleeve and having a shape for removably covering a knuckle of a thumb, said first edge being positioned adjacent to said thumb sleeve, said second edge abutting said first and third edges and being positioned adjacent to said first finger sleeve, said first plate having a bend therein extending between a juncture of said first and fourth edges and a juncture of said second and third edges, said bend forming an angle in an outer surface of said first plate generally between 200 degrees and 270 degrees;

a second plate being attached to said back hand covering and being positioned at a juncture of said first finger sleeve and said back hand covering, said second plate being positioned adjacent to said first plate, said second plate being positioned on a lateral edge of a knuckle of the finger when the finger is positioned in the first sleeve;

a thumb covering being attached to said thumb sleeve and having a size and shape to be removably positioned on an upper surface of the thumb so that said thumb covering extends along a length of and downwardly on either side of the thumb;

a finger covering being attached to said first finger sleeve and having a size and shape to cover an upper surface of the finger and extend along the length of the finger, said finger covering extending downwardly on a lateral edge of the finger when the finger is positioned in the first finger sleeve, said finger covering having a first end and a second end, said first end being rotationally coupled to said second plate, said finger covering having a break therein generally positioned between said first and second ends so that a first portion and a second portion are defined, said first portion being pivotally coupled to said second portion, an extension being attached to said second end of said finger covering, said extension extending past an end of the finger;

said finger covering having an aperture extending therethrough, said aperture being positioned adjacent to said extension; and said extension having a free edge having a notch extending therein.

* * * * *